US010068535B2

(12) United States Patent
Cho et al.

(10) Patent No.: US 10,068,535 B2
(45) Date of Patent: Sep. 4, 2018

(54) DISPLAY APPARATUS AND DRIVING METHOD THEREOF

(71) Applicant: Samsung Display Co., Ltd., Yongin-si, Gyeonggi-do (KR)

(72) Inventors: Jaehyun Cho, Seoul (KR); Hongsoo Kim, Anyang-si (KR); Bon-seog Gu, Seongnam-si (KR); Sehyuk Park, Hwaseong-si (KR); Cheolwoo Park, Suwon-si (KR); Ahyoung Son, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 222 days.

(21) Appl. No.: 15/050,190

(22) Filed: Feb. 22, 2016

(65) Prior Publication Data

US 2016/0284287 A1 Sep. 29, 2016

(30) Foreign Application Priority Data

Mar. 27, 2015 (KR) ..... 10-2015-0043537

(51) Int. Cl.

| | |
|---|---|
| ***G09G 3/36*** | (2006.01) |
| ***G09G 3/34*** | (2006.01) |
| ***G09G 3/20*** | (2006.01) |

(52) U.S. Cl.

CPC ..... *G09G 3/3607* (2013.01); *G09G 3/2003* (2013.01); *G09G 3/3413* (2013.01);

(Continued)

(58) Field of Classification Search

CPC .. G09G 3/2003; G09G 3/3426; G09G 3/3607; G09G 2320/0242;

(Continued)

(56) References Cited

U.S. PATENT DOCUMENTS

| | | | |
|---|---|---|---|
| 7,336,325 | B2 | 2/2008 | Hong |
| 7,580,023 | B2 | 8/2009 | Pugh et al. |

(Continued)

FOREIGN PATENT DOCUMENTS

| | | | |
|---|---|---|---|
| KR | 10-2004-0103997 | A | 12/2004 |
| KR | 10-2013-0062198 | A | 6/2013 |

(Continued)

*Primary Examiner* — Bryan Earles

(74) *Attorney, Agent, or Firm* — Lewis Roca Rothgerber Christie LLP

(57) ABSTRACT

A display apparatus comprises a display panel comprising a plurality of dimming areas, a light source unit configured to supply light to the display panel, a timing controller configured to receive a control signal and input data and to generate a gate control signal, a data control signal, and a light source control signal, a display panel driving unit configured to drive the display panel based on the gate and data control signals, and a light source driving unit configured to drive the light source unit based on the light source control signal, wherein based on the input data, the timing controller is configured to determine a first color of at least any one dimming area among the dimming areas and a second color in a complementary color relationship to the first color and to supply information on the first and second colors to the light source driving unit.

20 Claims, 7 Drawing Sheets

(52) U.S. Cl.
CPC ... *G09G 3/3426* (2013.01); *G09G 2320/0242* (2013.01); *G09G 2320/0261* (2013.01); *G09G 2320/062* (2013.01); *G09G 2360/16* (2013.01)

(58) Field of Classification Search
CPC ..... G09G 2320/0261; G09G 2320/062; G09G 2360/16; G09G 3/3413; G09G 5/06; G09G 5/10
See application file for complete search history.

(56) References Cited

U.S. PATENT DOCUMENTS

| | | | | |
|---|---|---|---|---|
| 8,456,413 | B2 | 6/2013 | Furukawa et al. | |
| 2006/0146007 | A1* | 7/2006 | Lim | G09G 3/3611 345/102 |
| 2008/0259099 | A1* | 10/2008 | Arai | G09G 3/2003 345/690 |
| 2010/0007589 | A1* | 1/2010 | Yeo | G09G 3/3413 345/83 |
| 2010/0259552 | A1* | 10/2010 | Hsu | G09G 3/3413 345/592 |
| 2010/0265281 | A1* | 10/2010 | Furukawa | G09G 3/3413 345/691 |
| 2012/0026203 | A1* | 2/2012 | Liu | G09G 3/3413 345/690 |
| 2013/0342430 | A1 | 12/2013 | Huang et al. | |

FOREIGN PATENT DOCUMENTS

| | | | |
|---|---|---|---|
| KR | 10-2013-0082013 | A | 7/2013 |
| KR | 10-2014-0088681 | A | 7/2014 |

* cited by examiner

DISPLAY APPARATUS AND DRIVING METHOD THEREOF

CROSS-REFERENCE TO RELATED APPLICATION

This patent application claims priority to and the benefit of Korean Patent Application No. 10-2015-0043537, filed on Mar. 27, 2015, the entire content of which is hereby incorporated by reference.

BACKGROUND

The present disclosure herein relates to a display apparatus and a driving method thereof.

Generally in a liquid crystal display apparatus of a space division type (kind), a liquid crystal display panel may include red, green, and blue color filters repeatedly arranged to respectively correspond to sub-pixels. At this point, a combination of the red, green, and blue color filters may serve as a minimum unit to realize different colors, and the full color image is realized by a transmittance difference between the sub-pixels of the liquid crystal display panel and the color combination of the red, green, and blue color filters. Here, a liquid crystal display having an arrangement in which the red, green, and blue color filters are arranged in different spaces in the liquid crystal panel is referred to as the space division type.

Additionally, in comparison to the space division type, there is a time division type (or a field sequential type or kind) capable of full-color realization with high transmittance and low manufacturing cost. In the time division type (kind), the color filters are omitted from the liquid crystal panel, and a backlight disposed at a rear side of the liquid crystal panel includes red, green, and blue light sources respectively emitting red, green, and blue color light. In addition, a frame is divided into three fields timely separated from each other. Each of the red, green, and blue light sources is lit in each field, thereby sequentially displaying red, green, and blue color images. Accordingly, an observer perceives the full color image obtained by combining the red, green, and blue color images by a physiological visual sensation.

However, in the liquid crystal display of the time division type, a color breakup phenomenon, in which the red, green and blue color images are separately perceived, may momentarily occur when a viewpoint is changed due to eye blinking or a movement of a screen or observer.

SUMMARY

Aspects of embodiments of the present disclosure are directed toward a display apparatus and a driving method thereof capable of mitigating (e.g., reducing) a color breakup phenomenon of a field sequential type display apparatus to improve (e.g., increase) display quality.

According to embodiments of the inventive concept, there is provided a display apparatus comprising: a display panel comprising a plurality of dimming areas; a light source unit configured to supply light to the display panel; a timing controller configured to receive a control signal and input data and to generate a gate control signal, a data control signal, and a light source control signal; a display panel driving unit configured to drive the display panel based on the gate and data control signals; and a light source driving unit configured to drive the light source unit based on the light source control signal, wherein based on the input data, the timing controller is configured to determine a first color of at least any one dimming area among the plurality of dimming areas and a second color in a complementary color relationship to the first color and to supply information on the first and second colors to the light source driving unit, and the light source driving unit is configured to turn on at least one light source supplying light of the first color to a central dimming area during an n-th sub-frame and to turn on at least one light source supplying light of the second color to the central dimming area during an (n±2)-th sub-frame.

In an embodiment, the timing controller comprises: a color information analyzing unit configured to analyze pixel colors of pixels based on pixel data corresponding to the pixels in the input data; a first color determining unit configured to determine the first color of the central dimming area based on the pixel colors; a second color determining unit configured to determine the second color of the central dimming area based on the first color; and an auxiliary color determining unit configured to determine a first auxiliary color of the central dimming area and a second auxiliary color of the central dimming area different from the first auxiliary color based on the first and second colors.

In an embodiment, the light source driving unit is configured to turn on a light source supplying light of the first auxiliary color to the central dimming area during an (n−1)-th sub-frame, and to turn on a light source supplying light of the second auxiliary color to the central dimming area during (n+1)-th sub-frame.

In an embodiment, the color information analyzing unit comprises: a first analyzing unit configured to analyze first pixel colors of the first pixels based on first pixel data corresponding to the first pixels in the central dimming area, and to generate first data comprising information on the first pixel colors; and a second analyzing unit configured to analyze second pixel colors of the second pixels based on second pixel data corresponding to the second pixels in peripheral dimming areas surrounding the central dimming area, and to generate second data comprising information on the second pixel colors.

In an embodiment, each of the first and second analyzing units comprises: a gray scale determining unit configured to determine a gray scale of each piece of the first pixel data and each piece of the second pixel data; a lookup table configured to store luminance data corresponding to the gray scale; and a pixel-by-pixel color determining unit configured to determine the first and second pixel colors based on the luminance data.

In an embodiment, each piece of the first pixel data and each piece of the second pixel data comprise red, green, and blue data, wherein the gray scale determining unit is configured to detect red, green, and blue luminance data corresponding to the red, green, and blue data from the lookup table, and wherein the pixel-by-pixel color determining unit is configured to determine maximum luminance data having a maximum numerical value among the red, green, and blue luminance data, and to determine colors having numerical values of a preset percentage or greater of the maximum numerical value as the first and second pixel colors.

In an embodiment, the first color determining unit comprises: a first ratio calculating unit configured to calculate a number of the first pixels for each color based on the first data and to generate first calculation data; a second ratio calculating unit configured to calculate a number of the second pixels for each color based on the second data and to generate second calculation data; a first calculating unit configured to receive the second calculation data and to generate third calculation data comprising color-by-color numerical value information on the second pixels converted from the number of the second pixels for each color; and a second calculating unit configured to determine the first color based on the first and third calculation data.

In an embodiment, the second calculating unit is configured to sum the number of the first pixels and the second pixel numerical value information for each color, and to determine a color having a largest summed value as the first color.

In an embodiment, three of the first color, the second color, the first auxiliary color, and the second auxiliary color comprise red, green, and blue.

In an embodiment, any one of the first and second colors is a mixed color, and each of the first and second auxiliary colors is one of three primary colors forming the mixed color.

In an embodiment, when the first color is white, the second color is any one of red, green, and blue.

According to embodiments of the inventive concept, there is provided a driving method of a display apparatus, the driving method comprising: externally receiving input data; performing a color information analyzing operation for analyzing pixel colors of pixels based on pixel data corresponding to the pixels in the input data; performing a first color determining operation for determining a first color of a central dimming area of any one of a plurality of dimming areas based on the pixel colors; performing a second color determining operation for determining a second color in a complementary color relationship to the first color; supplying light of the first color to the central dimming area during an n-th sub-frame; and supplying light of the second color to the central dimming area during an (n±2)-th sub-frame.

In an embodiment, the driving method further comprises: performing an auxiliary color determining operation for determining a first auxiliary color and a second auxiliary color different from the first auxiliary color based on the first and second colors; supplying light of the first auxiliary color to the central dimming area during an (n−1)-th sub-frame; and supplying light of the second auxiliary color to the central dimming area during an (n+1)-th sub-frame.

In an embodiment, light of a mixed color is supplied to the central dimming area during at least one of the n-th sub-frame and the (n±2)-th sub-frame, light of any one of three primary colors forming the mixed color is supplied to the central dimming area during the (n−1)-th sub-frame, and light of another color of the three primary colors forming the mixed color is supplied to the central dimming area during the (n+1)-th sub-frame.

In an embodiment, the color information analyzing operation comprises: performing a first analyzing operation for analyzing first pixel colors of first pixels based on first pixel data corresponding to the first pixels in the central dimming area; performing a second analyzing operation for analyzing second pixel colors of second pixels based on second pixel data corresponding to the second pixels in peripheral dimming areas surrounding the central dimming area; generating first data comprising information on the first pixel colors; and generating second data comprising information on the second pixel colors.

In an embodiment, each of the first and second analyzing operations comprises: performing a gray scale determining operation for determining a gray scale of each piece of the first pixel data and each piece of the second pixel data; and performing a pixel-by-pixel color determining operation for retrieving luminance data corresponding to the gray scale from a lookup table and determining the first and second pixel colors based on the luminance data.

In an embodiment, each piece of the first pixel data and each piece of the second pixel data comprise red, green, and blue data, wherein red, green, and blue luminance data corresponding to the red, green, and blue data are retrieved from the lookup table in the gray scale determining operation; and wherein the pixel-by-pixel color determining operation comprises determining maximum luminance data having a maximum numerical value among the red, green, and blue luminance data and determining a color having a numerical value of a preset percentage or greater of the maximum numerical value as the first and second pixel colors.

In an embodiment, the first color determining operation comprises: performing a first ratio calculating operation for calculating a number of the first pixels for each color based on the first data and generating first calculation data; performing a second ratio calculating operation for calculating a number of the second pixels for each color based on the second data and generating second calculation data; performing a first calculating operation for receiving the second calculation data and performing a conversion on the number of the second pixels for each color to generate third calculation data comprising color-by-color numerical value information on the second pixels; and performing a second calculating operation for determining the first color based on the first and third calculation data.

In an embodiment, in the second calculating operation, the information on the number of the first pixels and the second pixel numerical value information are summed for each color, and a color having a largest summed value is determined as the first color.

In an embodiment, red light is supplied to the central dimming area during any one sub-frame, green light is supplied to the central dimming area during another sub-frame, and blue light is supplied to the central dimming area during still another sub-frame.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
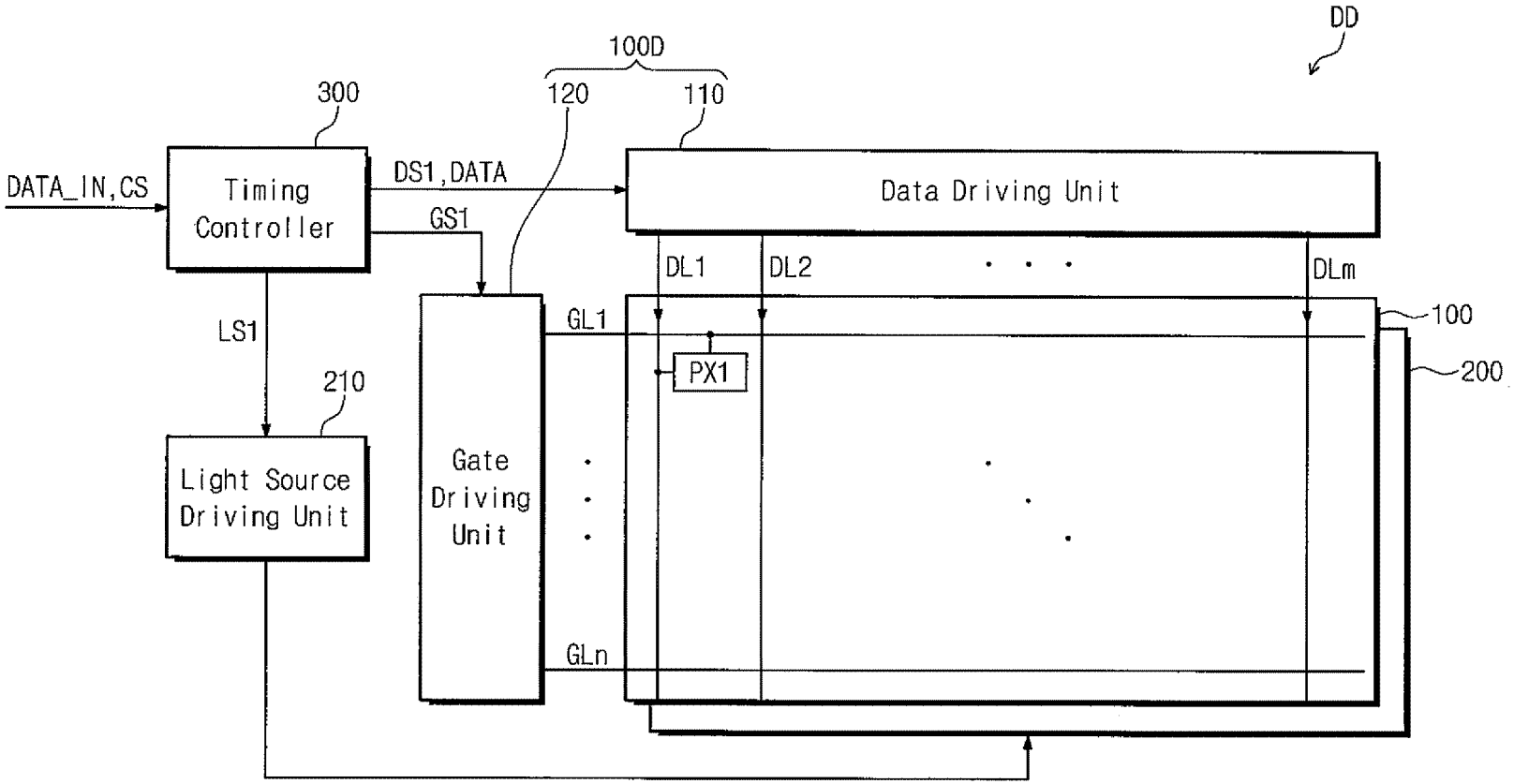
FIG. 1 is a block diagram of a display apparatus according to an embodiment of the present inventive concept.

Embodiments of the inventive concept will be described below in more detail with reference to the accompanying drawings. In addition, aspects, features, and effects of the inventive concept will be easily understood through embodiments in relation to the drawings. The inventive concept is, however, not limited to embodiments described herein and may be embodied and modified in various forms. Rather, these embodiments are provided so that this disclosure will be thorough and complete, and will fully convey the scope of the inventive concept to those skilled in the art. Accordingly, the scope of the inventive concept should not be construed as limited to the embodiments set forth herein. Furthermore, like reference numerals in the following embodiments and drawings refer to like elements throughout.

Hereinafter, exemplary embodiments of the inventive concept will be described in more detail with reference to the accompanying drawings.

FIG. 1 is a block diagram of a display apparatus according to an embodiment of the present inventive concept.

Referring to FIG. 1, a display apparatus DD may include a display panel 100, a display panel driving unit 100D, a light source unit 200, a light source driving unit 210, and a timing controller 300.

The display panel 100 generates an image corresponding to input image data. The display panel 100 may be a non-self-emission display panel and in this embodiment, a description is exemplarily provided about a case in which the display panel 100 is a liquid crystal display panel.

The display panel 100 includes a plurality of gate lines GL1 to GLn, a plurality of data lines DL1 to DLm, and a plurality of pixels PX1. The plurality of gate lines GL1 to GLn extend in a row direction and are arranged with each other along a column direction in parallel. The plurality of data lines DL1 to DLm extend in the column direction and are arranged with each other along the row direction in parallel. The plurality of pixels PX1 may be respectively connected to any one of the gate lines GL1 to GLn and any one of the data lines DL1 to DLm. FIG. 1 exemplarily illustrates a pixel PX1 connected to a first gate line GL1 and a first data line DL1.

The timing controller 300 receives input data DATA_IN and a control signal CS from the outside (e.g., an external graphic controller) of the display apparatus DD. The input data DATA_IN may include red, green, and blue data. The control signal CS may include a vertical sync signal that is a frame distinction signal, a horizontal sync signal that is a row distinction signal, a data enable signal for displaying an area to which data is input, and a clock signal.

The timing controller 300 generates a gate control signal GS1 and a data control signal DS1 on the basis of the control signal CS. The timing controller 300 outputs the gate control signal GS1 to the gate driving unit 120 and the data control signal DS1 to the data driving unit 110.

The timing controller 300 determines first and second colors that are in a complementary color relationship on the basis of the input data DATA_IN, and provides information on the first and second colors to the light source driving unit 210. A detailed description about this is provided below.

The display panel driving unit 100D drives the display panel 100. The display panel driving unit 100D may include the data driving unit 110 and the gate driving unit 120. The gate control signal GS1 is a signal for driving the gate driving unit 120 and the data control signal DS1 is a signal for driving the data driving unit 110.

The data driving unit 110 generates a gray scale voltage according to output data DATA converted based on the data control signal DS1 and output the gray scale voltage to the data lines DL1 to DLm. The data control signal DS1 may include a horizontal start signal that notifies a transmission start of the converted output data DATA to the data driving unit 110, a load signal for applying the gray scale voltage to the data lines DL1 to DLm, and an inversion signal for inverting a polarity of a data voltage with respect to a common voltage.

The gate driving unit 120 generates a gate signal on the basis of the gate control signal GS1 and outputs the gate signal to the gate lines GL1 to GLn. The gate control signal GS1 may include a scan start signal for instructing a scan start, at least one clock signal for controlling an output period of a gate-on voltage, and an output enable signal limiting a continuation time of the gate-on voltage. The gate driving unit 120 sequentially outputs the gate signal. Accordingly, the plurality of pixels PX1 may be sequentially scanned row by row with the gate signal.

The light source unit 200 is located on the rear side of the display panel 100 and provides light from the rear side of the display panel 100. The light source unit 200 may employ a plurality of light emitting diodes as light sources, and in this case, the plurality of light emitting diodes may be arranged in a stripe type along one direction on a printed circuit board or in a matrix type. The light source driving unit 210 may receive a light source control signal LS1 from the timing controller 300 to drive the light source unit 200 in synchronization with the display panel 100.

Figure 2:
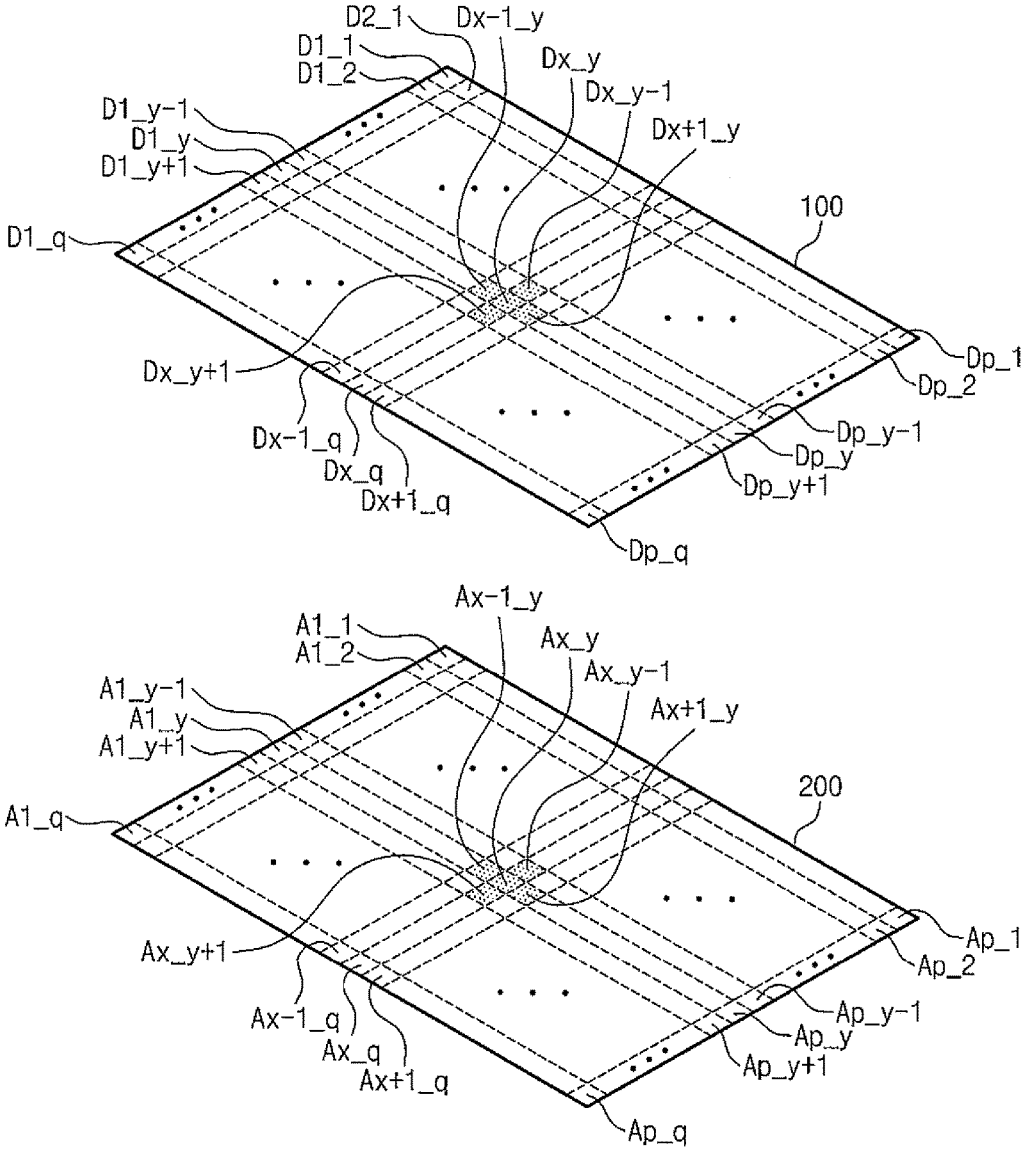
FIG. 2 is a schematic exploded perspective view of the display apparatus illustrated in FIG. 1.

FIG. 2 is a schematic exploded perspective view of the display apparatus illustrated in FIG. 1.

Referring to FIG. 2, the display panel 100 may be divided into a plurality of dimming areas D1_1 to Dp_q. The display panel 100 may have a two-dimensional structure in which the dimming areas D1_1 to Dp_q are divided along two directions different from each other. In an embodiment, the dimming areas D1_1 to Dp_q may be formed on the display panel 100 in a matrix structure of p×q, where p and q are respectively positive integers.

The light source unit 200 may include a plurality of light source blocks A1_1 to Ap_q disposed corresponding to the dimming areas D1_1 to Dp_q, respectively. The light source blocks A1_1 to Ap_q may respectively provide light to corresponding dimming areas D1_1 to Dp_q.

Figure 3:
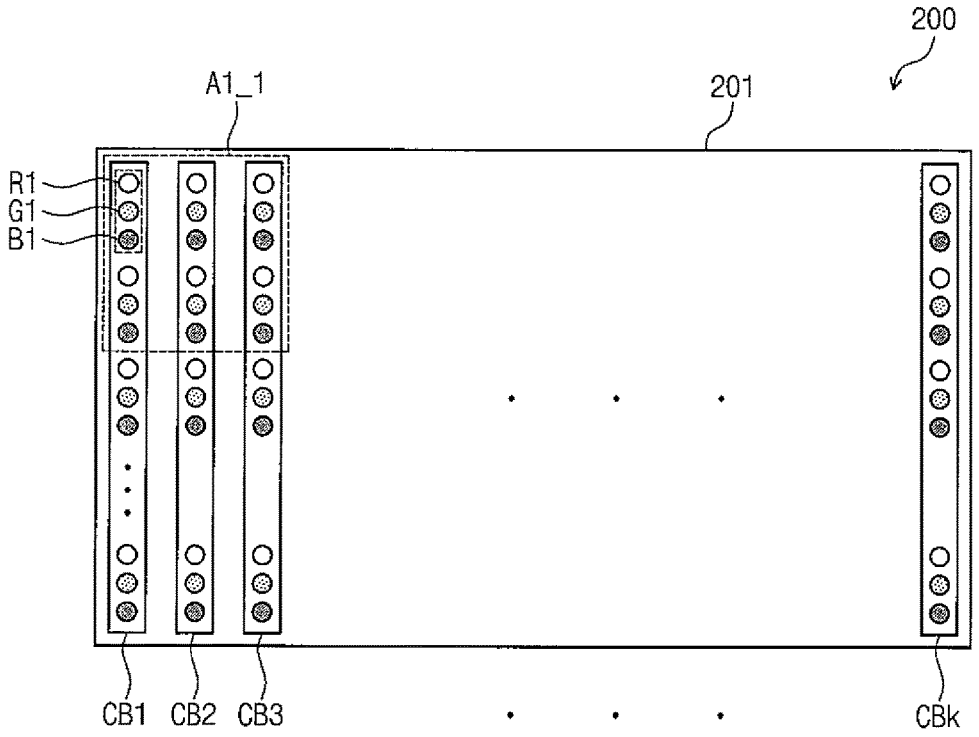
FIG. 3 is a schematic plan view of the light source unit illustrated in FIG. 1.

FIG. 3 is a schematic plan view of the light source unit illustrated in FIG. 1.

Referring to FIGS. 2 and 3, the light source unit 200 may include a bottom chassis 201, a first to k-th circuit bars CB1 to CBk (where k is a positive integer) arranged in one direction on the bottom chassis 201, and a plurality of light sources R1, G1, and B1 mounted on the first to k-th circuit bars CB1 to CBk.

In an embodiment, the first light sources R1 may be light sources emitting red color light, the second light sources G1 may be light sources emitting green color light, and the third light sources B1 may be light sources emitting blue color light. In another embodiment of the inventive concept, fourth light sources emitting white color light may be further disposed on the first to k-th circuit bars CBI to CBk.

The first light source block A1_1 is illustrated to have six first light sources R1, six second light sources G1, and six third light sources B1, but is not limited thereto.

The light source driving unit 210 (e.g., of FIG. 1) may control the on and/or off states of the first light sources R1, the second light sources G1, and the third light sources B1 when the light source blocks Al_1 to Ap_q provide light to the dimming areas D1_1 to Dp_q.

In an embodiment, the first light sources R1, the second light sources G1, and the third light sources B1 may provide light having identical or substantially identical intensity to the display panel 100 and control luminance of a displayed image through a transmittance control of each of the pixels PX1 (e.g., of FIG. 1) of the display panel 100. However, embodiments of the present inventive concept are not limited thereto and in another embodiment, the luminance of the displayed image may be adjusted by controlling intensity of the light from the first light sources R1, the second light sources G1, and the third light sources B1.

Figure 4:
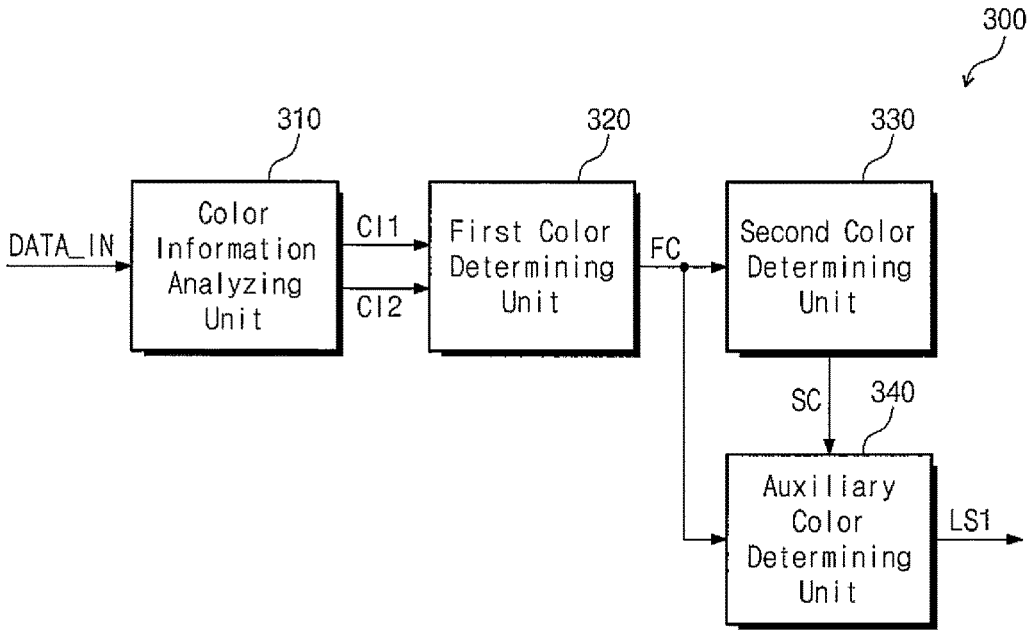
FIG. 4 is an internal block diagram of the timing controller illustrated in FIG. 1.

FIG. 4 is an internal block diagram of the timing controller illustrated in FIG. 1.

Referring to FIGS. 2 and 4, the timing controller 300 may include a color information analyzing unit 310, a first color determining unit 320, a second color determining unit 330, and an auxiliary color determining unit 340.

The color information analyzing unit 310 analyzes pixel colors corresponding to the pixels PX1 (e.g., of FIG. 1) on the basis of the input data DATA_IN. In further detail, the color information analyzing unit 310 analyzes pixel data corresponding to one pixel among the input data DATA_IN. The pixel data is data including information on colors displayed by one pixel.

Each piece of the pixel data may include red, green, and blue data. The color information analyzing unit 310 may determine a pixel color corresponding to one pixel on the basis of the red, green, and blue data. That is, the pixel color corresponding to one pixel is a color determined based on the pixel data. A detailed description about determining the pixel color is provided below in relation to FIGS. 5 and 6.

The dimming areas D1_1 to Dp_q may include a central dimming area Dx_y that is a target for determining a first color, and peripheral dimming areas Dx_y−1, Dx_y+1, Dx−1_y, and Dx+1_y disposed around (e.g., surrounding) the central dimming area Dx_y. In an embodiment, each of the peripheral dimming areas Dx_y−1, Dx_y+1 ,Dx−1_y, and Dx+1_y may be arranged in a row and column direction based on the central dimming area Dx_y and disposed adjacent to the central dimming area Dx_y. In another embodiment, the peripheral dimming areas may be defined as eight areas surrounding the central dimming area Dx_y. In other words, in this case, the peripheral dimming areas may include dimming areas contacting vertices of the peripheral dimming areas Dx_y−1, Dx_y+1, Dx−1_y, and Dx+1_y and the central dimming area Dx_y.

Each of the dimming areas D1_1 to Dp_q may become the central dimming area. In an embodiment, because surrounded by the dimming areas, the central dimming area Dx_y may include four periphery dimming areas Dx_y−1, Dx_y+1, Dx−1_y, and Dx+1_y. Unlike the embodiment, when a dimming area D1_1 disposed in a first row and first column becomes the central dimming area, two dimming areas D1_2, and D2_1 may become the periphery dimming areas. In other words, the number of the periphery dimming areas may differ according to a location of the central dimming area.

The color information analyzing unit 310 generates first data CI1 including information on first pixel colors corresponding to the first pixels disposed in the central dimming area Dx_y. In addition, the color information analyzing unit 310 may generate second data CI2 including information on second pixel colors corresponding to the second pixels disposed in the peripheral dimming areas Dx_y−1, Dx_y+1, Dx−1_y, and Dx+1_y.

The first color determining unit 320 receives the first and second data CI1 and CI2. The first color determining unit 320 determines the first color on the basis of the first and second data CI1 and CI2, and generates first color data FC including information on the first color.

The second color determining unit 330 receives the first color data FC. The second color determining unit 330 determines a second color that is in a complementary color relationship with the first color on the basis of the first color data FC. The second color determining unit 330 generates second color data SC including information on the second color. The complementary relationship may be defined as a case in which light of the first color is mixed with light of the second color to create or appear as white light. For example, when the first color is red, the second color is cyan. When the first color is magenta, the second color is green, and when the first color is yellow, the second color is blue. In addition, when the first color is white, the second color may be any one of red, green, and blue.

The auxiliary color determining unit 340 receives the first color data FC and the second color data SC. The auxiliary color determining unit 340 may determine first and second auxiliary colors on the basis of the first and second color data FC and SC. The first and second auxiliary colors may be different from each other. The first auxiliary color may be any one of three primary colors, and the second auxiliary color may be another one of the three primary colors.

Because the first and second colors are in a complementary relationship, any one of the first and second colors may be a mixed color. At this point, the first and second auxiliary colors may be determined as colors forming the mixed color. As an example, when the first and second colors are respectively magenta and green, the first and second auxiliary colors may be red and blue, respectively.

The auxiliary color determining unit 340 may generate a light source control signal LS1 having information on the first color data FC, the second color data SC, the first auxiliary color data, and the second auxiliary color data.

Figure 5:
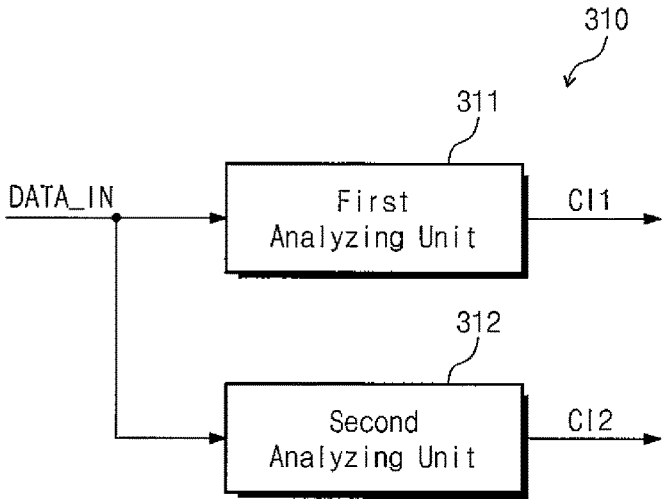
FIG. 5 is an internal block diagram of the color information analyzing unit illustrated in FIG. 4.
Figure 6:
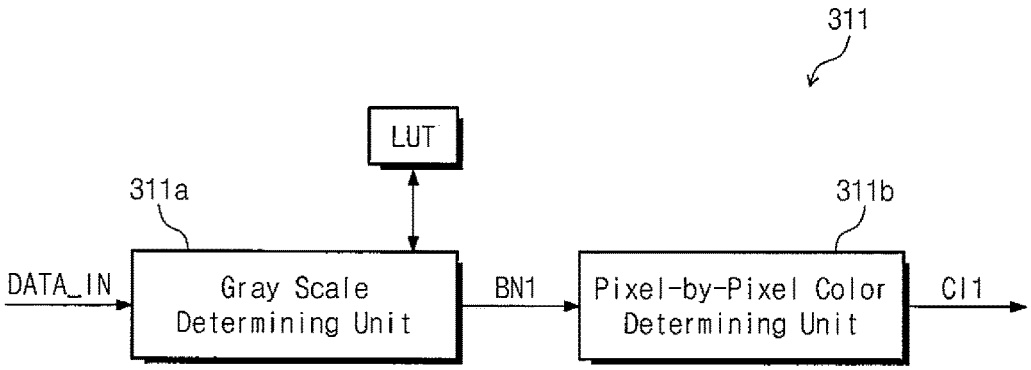
FIG. 6 is an internal block diagram of the first analyzing unit illustrated in FIG. 5.

FIG. 5 is an internal block diagram of the color information analyzing unit illustrated in FIG. 4; FIG. 6 is an internal block diagram of the first analyzing unit illustrated in FIG. 5.

Referring to FIGS. 2, 5, and 6, the color information analyzing unit 310 includes a first analyzing unit 311 and a second analyzing unit 312.

The first analyzing unit 311 analyzes the first pixel data corresponding to the first pixels, and the second analyzing unit 312 analyzes the second pixel data corresponding to the second pixels.

The first analyzing unit 311 may include a gray scale determining unit 311*a*, a lookup table LUT, and a pixel-by-pixel color determining unit 311*b*.

The gray scale determining unit 311*a* analyzes each piece of red, green, and blue data of the first pixel data. A description is exemplarily provided about analyzing red data of one pixel. The gray scale determining unit 311*a* determines a gray scale of the red data. The lookup table LUT stores luminance data corresponding to each gray scale. The luminance data is data numerically indicating a luminance level of an image displayed when a gray scale voltage corresponding to a preset or predetermined gray scale is applied to one pixel. As the luminance level becomes higher, the luminance data may have a greater numerical value. The gray scale determining unit 311*a* retrieves (e.g., reads) red luminance data corresponding to the gray scale of the red data from the lookup table LUT.

The gray scale determining unit 311*a* generates color luminance data BN1 including the red luminance data, green luminance data corresponding to a gray scale of green data, and blue luminance data corresponding to a gray scale of blue data.

The pixel-by-pixel color determining unit 311*b* receives the color luminance data BN1. The pixel-by-pixel color determining unit 311*b* determines maximum luminance data having a maximum number among the red luminance data, green luminance data, and blue luminance data. The pixel-by-pixel color determining unit 311*b* determines luminance data having a numerical value of a preset or predetermined percentage or greater of a maximum luminance data value. The pixel-by-pixel color determining unit 311*b* determines, as the pixel color, a color corresponding to at least any one of the red, green, and blue luminance data having a numerical value of the preset or predetermined percentage or greater. For example, when the red luminance data has the preset or predetermined percentage or greater of the maximum number, the pixel color may be red. In addition, when the blue and green luminance data have a numerical value of the preset or predetermined percentage or greater of the maximum number, the pixel color may be cyan that is a mixed color of blue and green.

The pixel-by-pixel color determining unit 311*b* may determine the first pixel colors based on the color luminance data BN1 and may then generate the first data CI1 including information on the first pixel colors.

In further detail, a description is exemplarily provided about a case in which the red luminance data has a number of about 100, the green luminance data has a number of about 20, and the blue luminance data has a number of about 80. In this case, because the red luminance data has the maximum number, the maximum number is about 100 and the red luminance data becomes the maximum luminance data. The pixel-by-pixel color determining unit 311*b* determines whether the red, green, and blue luminance data have a numerical value of the preset or predetermined percentage or greater of the maximum number. In an embodiment, the preset or predetermined percentage may be about 50%. The predetermine percentage may be flexibly varied according to the size or display quality of a product. For example, in another embodiment, the preset or predetermined percentage may be about 70%.

In this example, the red and blue luminance data may have a numerical value of 50% or greater of the maximum number. Accordingly, the first pixel color may be magenta, that is, a mixed color of red and blue. In this example, the pixel-by-pixel color determining unit 311*b* may generate the first data CI1 including information on the first pixel color of magenta.

In an embodiment, because the maximum luminance data is determined as one having the greatest number of the red, green, and blue luminance data for one pixel, the maximum luminance data for each pixel may be different.

As an example, a description will be provided about a case in which a gray scale has 256 gray levels. In this case, although a luminance data has a numerical value of preset or predetermined percentage or greater, but is a smaller than a gray level of 50, the luminance data may be excluded from a determination target of the pixel color. In the example, the gray scale having a gray level of 50 or greater is exemplified but is not limited thereto, and may be flexibly varied according to the size or display quality of a product.

In further detail, a yellow moon in the night is exemplified. For any one pixel representing the yellow moon, gray scale information included in the red data may be a gray level of about 90, gray scale information included in the green data may be a gray level of about 80, and gray scale information included in the blue data may be a gray level of about 30. The red luminance data corresponding to gray scale information of the red data is about 30, the green luminance data corresponding to gray scale information of the green data is about 28, and the blue luminance data corresponding to gray scale information of the blue data is about 15. In this case, the red, green, and blue luminance data may have a numerical value of 50% or greater of the maximum number. Accordingly, the maximum number is small for a dark screen. Accordingly, in order to select a more accurate pixel color, the pixel-by-pixel color determining unit 311*b* may select, as the pixel color, only a color having a gray scale equal to or greater than a preset or predetermined gray scale. Accordingly, the blue data having a gray level of 30 may be excluded from a pixel-by-pixel color determination target. As a result, the pixel color in this embodiment may be yellow that is a mixed color of red and green.

An internal block diagram of the second analyzing unit 312 may be substantially identical to that of the first analyzing unit 311, and a description thereabout may not be provided. The second analyzing unit 312 determines second pixel colors corresponding to second pixels arranged in the periphery dimming areas Dx_y−1, Dx_y+1, Dx−1_y, and Dx+1_y. The second analyzing unit 312 generates the second data CI2 including information on the second pixel colors.

Figure 7:
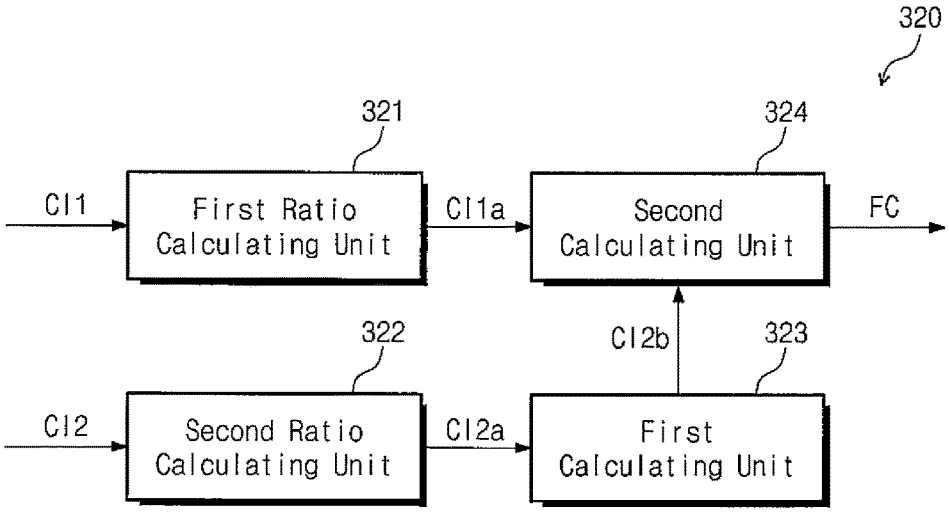
FIG. 7 is an internal block diagram of the first color determining unit illustrated in FIG. 4.
Figure 8:
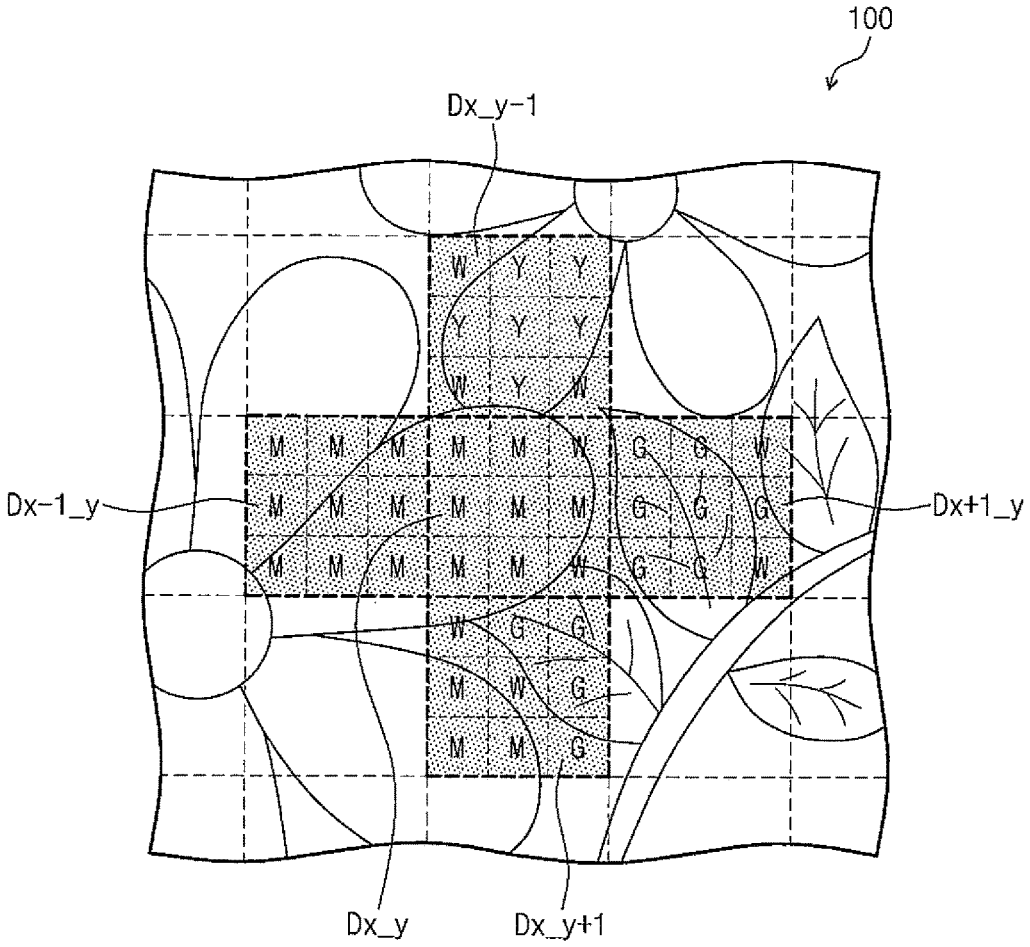
FIG. 8 is a schematic plan view of the display panel illustrated in FIG. 1.

FIG. 7 is an internal block diagram of the first color determining unit illustrated in FIG. 4. FIG. 8 is a schematic plan view of a display panel of illustrated in FIG. 1. For convenience of explanation, FIG. 8 schematically illustrates a display panel 100 displaying an image thereon.

Referring to FIGS. 2, 7, and 8, the first color determining unit 320 may include a first ratio calculating unit 321, a second ratio calculating unit 322, a first calculating unit 323, and a second calculating unit 324.

The first ratio calculating unit 321 receives the first data CI1. For convenience of explanation, FIG. 8 illustrates information on the first pixel colors included in the first data CI1 and the second pixel colors included in the second data CI2. For convenience of explanation, FIG. 8, each of the central dimming area Dx-y and peripheral dimming areas Dx_y−1, Dx_y+1, Dx−1_y, Dx+1_y is illustrated to include pixels arranged in a matrix structure of three rows and three columns; however, embodiments of the present invention are not limited thereto.

The first ratio calculating unit 321 may calculate the number of the first pixels for each color on the basis of the first pixel colors. In an embodiment, in view of the first pixel color of each of the first pixels arranged in the central dimming area Dx_y, the number of first pixels having a magenta pixel color is 7 and the number of first pixels having a white pixel color is 2. Accordingly, the first ratio calculating unit 321 may generate first calculation data CI1*a* including information that the number of first pixels having the magenta pixel color is 7 and the number of first pixels having the white pixel color is 2.

The second ratio calculating unit 322 may calculate the number of the second pixels for each color on the basis of the first pixel colors. In an embodiment, in view of the second pixel colors of each of the second pixels arranged in the peripheral dimming areas Dx_y−1, Dx_y+1, Dx−1_y, and Dx+1_y, the number of second pixels having a magenta pixel color is 12, the number of second pixels having a green pixel color is 11, the number of second pixels having a white pixel color is 7, and the number of second pixels having a yellow pixel color is 6. Accordingly, the second ratio calculating unit 322 may generate second calculation data CI2*a* including information that the number of second pixels having the magenta pixel color is 12, the number of second pixel having the green pixel color is 11, the number of second pixels having the white pixel color is 7, and the number of second pixels having the yellow pixel color is 6.

The first calculating unit 323 receives second calculation data CI2*a* and performs a conversion on the information on the number of the second pixels for each color included in the second calculation data CI2*a* to generate third calculation data CIb including numerical information on the second pixels for each color. In an embodiment, the first calculating unit 323 multiplies the number of the second pixels for each color by a multiplier of 0.2 to generate numerical information on the second pixels for each color. In an embodiment, third calculation data CI2*a* may include numerical information of 2.4 on the second pixels having the magenta pixel color, numerical information of 2.2 on the second pixels having the green pixel color, numerical information of 1.4 on the second pixels having the white pixel color, and numerical information of 1.2 on the second pixels having the yellow pixel color. The multiplier multiplied by the number of pixels for each pixel color, which is included in the second calculation data CI2*a*, may be flexibly varied according to an effect between images displayed in each of the dimming areas D1_1 to Dp_q.

The second calculating unit 324 receives the first and third calculation data CI1*a* and CI2*b*. The second calculating unit 324 determines the first color on the basis of the first calculation data CI1*a* and the third calculation data CI2*b*. The second calculating unit 324 generates the first color data FC including information on the first color.

The second calculating unit 324 sums the number of first pixels for each color included in the first calculating data CI1*a* and the number of second pixels for each color included in the third calculation data CI2*b*. The second calculating unit 324 may determine, as the first color, a color having a largest value among the summed values for each color.

in an embodiment, a numerical value of the magenta pixel color is about 9.4 (i.e., 7+2.4), a numerical value of the white pixel color is about 3.4 (i.e., 2+1.4), a numerical value of the green pixel color is about 2.2 (i.e., 0+2.2), and a numerical value of the yellow pixel color is about 1.2 (i.e., 0+1.2) Accordingly, because the numerical value of the magenta pixel color is the largest, the first color of the central dimming area Dx_y is determined as magenta.

In an embodiment, the first color may be determined in consideration of effects among the peripheral dimming areas Dx_y−1, Dx_y+1, Dx−1_y, and Dx+1_y. For example, because light output from the light source unit 200 may affect, by diffusion, the dimming areas and areas corresponding thereto at the same time, the first color is determined by considering this in advance.

Figure 9:
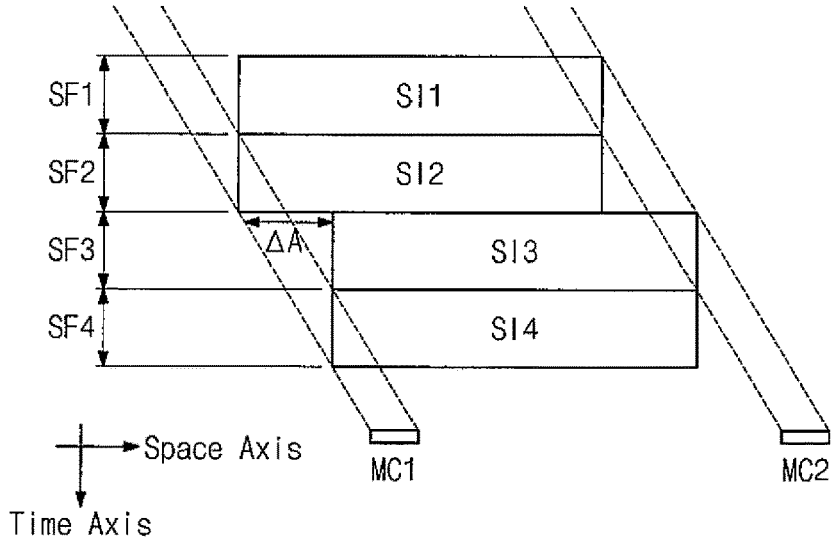
FIG. 9 is a view illustrating a driving scheme according to an embodiment of the present inventive concept.

FIG. 9 is a view illustrating a driving scheme according to an embodiment of the present inventive concept.

Referring to FIGS. 1, 2, and 9, one frame may include a first sub-frame SF1, a second sub-frame SF2, a third sub-frame SF3, and a fourth sub-frame SF4. The first to fourth sub-frames SF1, SF2, SF3, and SF4 may be sequentially defined according to a time order. The light source unit 200 may provide to the display panel 100 different color lights corresponding to the first to fourth sub-frames SF1, SF2, SF3, and SF4.

The display panel 100 may display a first sub-image SI1, a second sub-image SI2, a third sub-image SI3, and a fourth sub-image SI4 having different colors during the first to fourth sub-frames SF1, SF2, SF3, and SF4, respectively. The first sub-image SI1 may be displayed during the first sub-frame SF1, the second sub-image SI2 may be displayed during the second sub-frame SF2, the third sub-image SI3 may be displayed during the third sub-frame SF3, and the fourth sub-image SI4 may be displayed during the fourth sub-frame SF4. Accordingly, the user may view an image to which the first to fourth sub-images SI1 to SI4 are mixed at a time when one frame is completed.

The light source unit 200 may turn on at least one light source providing first color light to the central dimming area Dx-y at an n-th sub-frame, and turn on at least one light source providing second color light to the central dimming area Dx_y during an (n±2)-th sub-frame. The light source unit 200 may turn on at least one light source providing first auxiliary color light to the central dimming area Dx-y at the (n−1)-th sub-frame, and turn on at least one light source providing second auxiliary color light to the central dimming area Dx_y during the (n+1)-th sub-frame.

When n is 2, the light source unit 200 provide the first color light to the display panel 100 at the second sub-frame SF2, the second color light to the display panel 100 at the fourth sub-frame SF4, the first auxiliary color light to the display panel 100 at the first sub-frame SF1, and the second auxiliary color light to the display panel 100 at the third sub-frame SF3.

During two separated sub-frames with one sub-frame disposed therebetween, the first and second color lights may be separately provided. In other words, any one of the first and second color lights is provided to the central dimming area Dx_y and then any one of (e.g., a corresponding one of) the first and second auxiliary color lights is provided to the central dimming areas Dx_y. The order of turn-on of the first and second color lights, and the first and second auxiliary color lights may be changed as long as the condition is met.

Table 1 shows a color of light that the light source unit 200 provides to the central dimming area Dx_y during the first to fourth sub-frames SF1, SF2, SF3, and SF4.

TABLE 1

| | first sub-frame | second sub-frame | third sub-frame | fourth sub-frame |
|---|---|---|---|---|
| 1 | blue | red | green | cyan |
| 2 | red | green | blue | magenta |
| 3 | green | blue | red | yellow |
| 4 | red | yellow | green | blue |
| 5 | green | cyan | blue | red |
| 6 | blue | magenta | red | green |
| 7 | red | white | green | blue |

In view of each of 7 cases, the light source unit 200 provides red light during at least any one of the first to fourth sub-frames SF1, SF2, SF3, and SF4, green light during another sub-frame, and blue light during still another frame. Accordingly, all colors may be represented in one frame.

In view of a seventh case, the light source unit 200 provides white light to the central dimming area Dx_y during the second sub-frame SF2. When it is assumed that the first color is provided at the second sub-frame SF2, the first color may be white in this case. At this point, the light source unit 200 provides blue light to the central dimming area Dx_y during the fourth sub-frame SF4. However, the embodiment is not limited thereto. For example, even though the white light is mixed with any color light, the mixed light becomes white. Accordingly, the second color may be diversely varied. Accordingly, the second color may be any one of red, green, and blue.

Like a determination based on the image of FIG. 8, a description is exemplarily provided about a sixth case where the first color is magenta, the second color is green, the first auxiliary color is blue, and the second auxiliary color is red. The third light sources B1 (e.g., of FIG. 3) may be turned on during the first sub-frame SF1, the first light sources R1 (e.g., of FIG. 3) and the third light sources B1 (e.g., of FIG. 3) may be turned on during the second sub-frame SF2, and the second light sources G1 (e.g., of FIG. 3) may be turned on during the fourth sub-frame SF4.

In an embodiment, a description will be exemplarily provided about a case in which the image is moved by a distance (e.g., predetermined distance) ΔA between the second sub-frame SF2 and the third sub-frame SF3 or a viewpoint of a viewer is moved by a distance ΔA between the second sub-frame SF2 and the third sub-frame SF3. In this case, the third sub image SI3 may move along the space axis. Accordingly, the user may view an image that the second sub-image SI2 of a magenta color and the fourth sub-image SI4 of a green color at a first edge MC1 of the first to fourth sub images SI1, SI2, SI3, and SI4. At this point, white light that the first color (e.g., magenta) and the second color (e.g., green) make when mixed may be viewed at the first edge MC1 and as a result, a color breakup phenomenon that a color image is separately perceived may be mitigated (e.g., reduced).

In addition, a user may view an image in which the first sub-image SI1 of a blue color and the third sub-image SI3 of a red color are mixed at a second edge MC2. In other words, the first auxiliary color (e.g., blue) and the second auxiliary color (e.g., red) may be mixed and viewed as the first color (e.g., magenta) at the second edge MC2. The color viewed at the second edge may be substantially the same as the first color. Accordingly, although being separately perceived, a color image may be perceived as the same color as the first color of the central dimming area Dx_y. In other words, because viewing an image of the substantially same color as the first color that is a main color of the central dimming area Dx_y, the user may not perceive that the color is separated. As a result, a breakup phenomenon that a color image is separately perceived may be mitigated. In addition, compared to the luminance of the first color, luminances of the first and second auxiliary colors are relative low and may not be distinctly viewed by the user.

In an embodiment, a first color image may be provided to any one sub-frame, which is determined in consideration of the luminance information and color ratio information on an image displayed on the display panel 100. As a result, even when viewing an image of only the second auxiliary sub-image SI2 having the first color displayed, the user may view the image having a similar color to that of the original image due to eye blinking or the like.

In other words, during the second sub-frame SF2, the light source blocks A1_1 to Ap_q may respectively provide the first color light to the dimming areas D1_1 to Dp_q. For example, during the second sub-frame SF2, the first light source block A1_1 may provide yellow light to the first dimming area D1_1, and the second light source block A1_2 may provide blue light to the second dimming area D1_2. Accordingly, when some of the sub-frames are missed, because it is not that only some of red, green, and blue color images are perceived, a phenomenon that the color of the image is distorted may be mitigated. In addition, unlike an existing RGB structure, because such a structure does not require a color filter, light efficiency of the display apparatus DD (e.g., of FIG. 1) may be improved.

A description will be exemplarily provided about a case in which an image is moved between the second and third sub-frames SF2 and SF3 by a preset or predetermined distance (e.g., ΔA). In this case, the first and second sub-images SI1 and SI2 may be different only in color, and displayed at an identical or substantially identical position in the display panel 100. In addition, the third and fourth sub-images SI3 and SI4 may be different only in color, and displayed at an identical or substantially identical position in the display panel 100. In this case, when it is assumed that the display panel 100 is driven at about 120 Hz, the light source unit 200 may be driven at about 240 Hz, and sequentially provide the first auxiliary color, the first color, the second auxiliary color, and the second color to the display panel 100 for about 1/240 of a second.

In addition, in another embodiment, the first to fourth sub-images SI1, SI2, SI3, and SI4 may be different only in color and display at an identical or substantially identical position in the display panel 100. In this case, when it is assumed that the display panel 100 is driven at about 60 Hz, the light source unit 200 may be driven at about 240 Hz, and sequentially provide the first auxiliary color, the first color, the second auxiliary color, and the second color to the display panel 100 for about 1/240 of a second.

Figure 10:
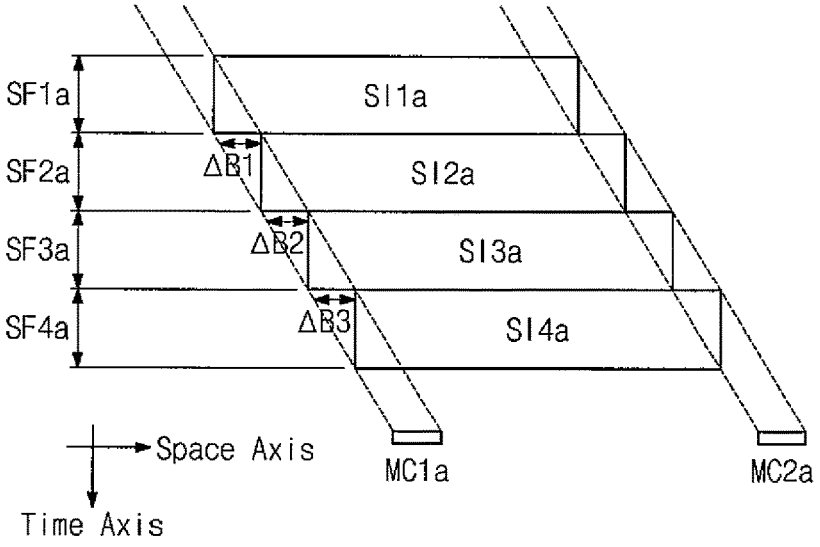
FIG. 10 is a view illustrating a driving scheme according to another embodiment of the present inventive concept.

FIG. 10 is a view illustrating a driving scheme according to another embodiment of the present inventive concept.

Referring to FIGS. 1 and 10, one frame may include a first sub-frame SF1*a*, a second sub-frame SF2*a*, a third sub-frame SF3*a*, and a fourth sub-frame SF4*a*. The light source unit 200 may provide light of different colors to the display panel 100 during each of the first to fourth sub-frames SF1*a*, SF2*a*, SF3*a*, and SF4*a*. The user may view an image to which images respectively displayed at the first to fourth sub-frames SF1*a*, SF2*a*, SF3, and SF4 are mixed at a time of completion of one frame.

In an embodiment, a description will be exemplary provided about a case where an image is moved by distances (e.g., predetermined distances) ΔB1,ΔB2,ΔB3 during the first to fourth sub-frames SF1*a*, SF2*a*, SF3*a*, and SF4*a* or a case in which a viewpoint of the user is moved by distances ΔB1,ΔB2,ΔB3 at the first to fourth sub-frames SF1*a*, SF2*a*, SF3*a*, and SF4*a*.

In an embodiment, the first to fourth sub-images SI1*a*, SI2*a*, SI3*a*, and SI4*a* displayed during the first to fourth sub-frames SF1*a*, SF2*a*, SF3*a*, and SF4*a* are images displayed at different positions in the display panel 100, and the first to fourth sub-images SI1*a*, SI2*a*, SI3*a*, and SI4*a* may display color images different from each other. In this case, when it is assumed that the display panel 100 is driven at about 240 Hz, the light source unit 200 may be driven at about 240 Hz, and sequentially provide the first auxiliary color, the first color, the second auxiliary color, and the second color to the display panel 100 for about 1/240 second.

In addition, in another embodiment, as illustrated in FIG. 9, the first to fourth sub images SI1*a*, SI2*a*, SI3*a*, and SI4*a* are displayed at an identical or substantially identical position in the display panel 100, and the first to fourth sub images SI1*a*, SI2*a*, SI3*a*, and SI4*a* may display sub-images having different colors from each other. In this case, when it is assumed that the display panel 100 is driven at about 60 Hz, the light source unit 200 may be driven at about 240 Hz, and sequentially provide the first auxiliary color, the first color, the second auxiliary color, and the second color to the display panel 100 for about 1/240 second.

Light provided during the first to fourth sub-frames SF1*a*, SF2*a*, SF3*a*, and SF4*a* may be mixed at the first and second edges MC1*a* and MC2*a* of the image. As such, white light is viewed at the first and second edges MC1 and MC2. Accordingly, a breakup phenomenon that a color image is separately perceived may be mitigated. In addition, according to the embodiment, an image of a first color determined in consideration of luminance and a color ratio of the image is provided to any one sub-frame. As a result, even when viewing an image of only the second auxiliary sub-image SI2 having the first color, the user may view an image having a similar color to that of the original image due to eye blinking. Accordingly, when some of the sub-frames are missed, because it is not that only some of red, green, and blue color images are perceived, a phenomenon that the color of the image is distorted may be mitigated.

According to an embodiment of the inventive concept, a display panel displays an image of a first color during an n-th sub-frame and an image of a second color, which is in a complementary color relationship to the first color, during an (n±2)-th frame in one frame. Accordingly, display quality can be improved by mitigating (e.g., reducing) a color breakup phenomenon of a field sequential type display apparatus.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another area, element, or layer, it can be directly on, connected to, coupled to, or adjacent to the other area, element, or layer, or one or more intervening areas, elements, or layers may be present.

As used herein, the term "substantially," "about," and similar terms are used as terms of approximation and not as terms of degree, and are intended to account for the inherent variations in measured or calculated values that would be recognized by those of ordinary skill in the art.

The display apparatus and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display apparatus may be formed on one integrated circuit (IC) chip or on separate IC chips. Further, the various components of the display apparatus may be implemented on a flexible printed circuit film, a tape carrier package (TCP), a printed circuit board (PCB), or formed on a same substrate. Further, the various components of the display apparatus may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The above-disclosed subject matter is to be considered illustrative and not restrictive, and the appended claims and equivalents thereof are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A display apparatus comprising:

a display panel comprising a plurality of dimming areas;

a light source unit configured to supply light to the display panel;

a timing controller configured to receive a control signal and input data and to generate a gate control signal, a data control signal, and a light source control signal;

a display panel driving unit configured to drive the display panel based on the gate and data control signals; and a light source driving unit configured to drive the light source unit based on the light source control signal, wherein based on the input data, the timing controller is configured to determine a first color of at least any one dimming area among the plurality of dimming areas and a second color in a complementary color relationship to the first color and to supply information on the first and second colors to the light source driving unit, and the light source driving unit is configured to turn on at least one light source supplying light of the first color to a central dimming area during an n-th sub-frame and to turn on at least one light source supplying light of the second color to the central dimming area during an (n±2)-th sub-frame, and wherein the timing controller is configured to determine, for each pixel of a plurality of pixels of the display panel, maximum luminance data having a maximum numerical value among red, green, and blue luminance data, and to determine colors having numerical values of a preset percentage or greater of the maximum numerical value as pixel colors, and to determine the first color based on the colors.

2. The display apparatus of claim 1, wherein the timing controller comprises:

a color information analyzing unit configured to analyze the pixel colors of the pixels based on pixel data corresponding to the pixels in the input data;

a first color determining unit configured to determine the first color of the central dimming area based on the pixel colors;

a second color determining unit configured to determine the second color of the central dimming area based on the first color; and an auxiliary color determining unit configured to determine a first auxiliary color of the central dimming area and a second auxiliary color of the central dimming area different from the first auxiliary color based on the first and second colors.

3. The display apparatus of claim 2, wherein the light source driving unit is configured to turn on a light source supplying light of the first auxiliary color to the central dimming area during an (n−1)-th sub-frame, and to turn on a light source supplying light of the second auxiliary color to the central dimming area during an (n+1)-th sub-frame.

4. The display apparatus of claim 2, wherein the pixels comprise first pixels in the central dimming area and second pixels in peripheral dimming areas surrounding the central dimming area, wherein the pixel colors comprise first pixel colors of the first pixels and second pixel colors of the second pixels, and wherein the color information analyzing unit comprises:

a first analyzing unit configured to analyze the first pixel colors based on first pixel data corresponding to the first pixels, and to generate first data comprising information on the first pixel colors; and a second analyzing unit configured to analyze the second pixel colors based on second pixel data corresponding to the second pixels, and to generate second data comprising information on the second pixel colors.

5. The display apparatus of claim 4, wherein each of the first and second analyzing units comprises:

a gray scale determining unit configured to determine a gray scale of each piece of the first pixel data and each piece of the second pixel data;

a lookup table configured to store luminance data corresponding to the gray scale; and a pixel-by-pixel color determining unit configured to determine the first and second pixel colors based on the luminance data.

6. The display apparatus of claim 5, wherein each piece of the first pixel data and each piece of the second pixel data comprise red, green, and blue data, wherein the gray scale determining unit is configured to detect the red, green, and blue luminance data corresponding to the red, green, and blue data from the lookup table, and wherein the pixel-by-pixel color determining unit is configured to determine the maximum luminance data having the maximum numerical value among the red, green, and blue luminance data, and to determine the colors having numerical values of the preset percentage or greater of the maximum numerical value as the first and second pixel colors.

7. The display apparatus of claim 6, wherein the first color determining unit comprises:

a first ratio calculating unit configured to calculate a number of the first pixels for each color based on the first data and to generate first calculation data;

a second ratio calculating unit configured to calculate a number of the second pixels for each color based on the second data and to generate second calculation data;

a first calculating unit configured to receive the second calculation data and to generate third calculation data comprising color-by-color numerical value information on the second pixels converted from the number of the second pixels for each color; and a second calculating unit configured to determine the first color based on the first and third calculation data.

8. The display apparatus of claim 7, wherein the second calculating unit is configured to sum the number of the first pixels and the second pixel numerical value information for each color, and to determine a color having a largest summed value as the first color.

9. The display apparatus of claim 2, wherein three of the first color, the second color, the first auxiliary color, and the second auxiliary color comprise red, green, and blue.

10. The display apparatus of claim 2, wherein any one of the first and second colors is a mixed color, and each of the first and second auxiliary colors is one of three primary colors forming the mixed color.

11. The display apparatus of claim 1, wherein when the first color is white, the second color is any one of red, green, and blue.

12. A driving method of a display apparatus, the driving method comprising:

externally receiving input data;

performing a color information analyzing operation for analyzing pixel colors of pixels based on pixel data corresponding to the pixels in the input data;

performing a first color determining operation for determining a first color of a central dimming area of any one of a plurality of dimming areas based on the pixel colors;

performing a second color determining operation for determining a second color in a complementary color relationship to the first color;

supplying light of the first color to the central dimming area during an n-th sub-frame; and supplying light of the second color to the central dimming area during an (n±2)-th sub-frame, and wherein performing the first color determining operation and performing the second color determining operation comprises determining, for each pixel of the pixels, maximum luminance data having a maximum numerical value among red, green, and blue luminance data, and to determine colors having numerical values of a preset percentage or greater of the maximum numerical value pixel colors, and to determine the first color based on the pixel colors.

13. The driving method of claim 12, further comprising:

performing an auxiliary color determining operation for determining a first auxiliary color and a second auxiliary color different from the first auxiliary color based on the first and second colors;

supplying light of the first auxiliary color to the central dimming area during an (n−1)-th sub-frame; and supplying light of the second auxiliary color to the central dimming area during an (n+1)-th sub-frame.

14. The driving method of claim 13, wherein light of a mixed color is supplied to the central dimming area during at least one of the n-th sub-frame and the (n±2)-th sub-frame, light of any one of three primary colors forming the mixed color is supplied to the central dimming area during the (n−1)-th sub-frame, and light of another color of the three primary colors forming the mixed color is supplied to the central dimming area during the (n+1)-th sub-frame.

15. The driving method of claim 12, wherein the color information analyzing operation comprises:

performing a first analyzing operation for analyzing first pixel colors of first pixels based on first pixel data corresponding to the first pixels in the central dimming area;

performing a second analyzing operation for analyzing second pixel colors of second pixels based on second pixel data corresponding to the second pixels in peripheral dimming areas surrounding the central dimming area;

generating first data comprising information on the first pixel colors; and generating second data comprising information on the second pixel colors.

16. The driving method claim 15, where each of the first and second analyzing operations comprises:

performing a gray scale determining operation for determining a gray scale of each piece of the first pixel data and each piece of the second pixel data; and performing a pixel-by-pixel color determining operation for retrieving luminance data corresponding to the gray scale from a lookup table and determining the first and second pixel colors based on the luminance data.

17. The driving method of claim 16, wherein each piece of the first pixel data and each piece of the second pixel data comprise red, green, and blue data, wherein red, green, and blue luminance data corresponding to the red, green, and blue data are retrieved from the lookup table in the gray scale determining operation; and wherein the pixel-by-pixel color determining operation comprises determining maximum luminance data having the maximum numerical value among the red, green, and blue luminance data and determining the color having a numerical value of the preset percentage or greater of the maximum numerical value as the first and second pixel colors.

18. The driving method of claim 15, wherein the first color determining operation comprises:

performing a first ratio calculating operation for calculating a number of the first pixels for each color based on the first data and generating first calculation data;

performing a second ratio calculating operation for calculating a number of the second pixels for each color based on the second data and generating second calculation data;

performing a first calculating operation for receiving the second calculation data and performing a conversion on the number of the second pixels for each color to generate third calculation data comprising color-by-color numerical value information on the second pixels; and performing a second calculating operation for determining the first color based on the first and third calculation data.

19. The driving method claim 18, wherein in the second calculating operation, the information on the number of the first pixels and the second pixel numerical value information are summed for each color, and a color having a largest summed value is determined as the first color.

20. The driving method of claim 12, wherein red light is supplied to the central dimming area during any one sub-frame, green light is supplied to the central dimming area during another sub-frame, and blue light is supplied to the central dimming area during still another sub-frame.

* * * * *